US006471776B1

(12) United States Patent
Krossa et al.

(10) Patent No.: US 6,471,776 B1
(45) Date of Patent: Oct. 29, 2002

(54) APPARATUS FOR APPLYING ABRASIVE SUBSTANCES TO CONTINUOUS PAPER WEBS

(75) Inventors: Gisbert Krossa, Wülfrath; Walter Müller, Reichshof; Ernst Klas, Siegburg, all of (DE)

(73) Assignee: Vits Maschinenbau GmbH, Langenfeld (DE)

( * ) Notice: Subject to any disclaimer, the term of this patent is extended or adjusted under 35 U.S.C. 154(b) by 79 days.

(21) Appl. No.: 09/671,570

(22) Filed: Sep. 27, 2000

(30) Foreign Application Priority Data

Sep. 28, 1999 (DE) ..... 199 46 325

(51) Int. Cl.[7] ..... B05C 5/02

(52) U.S. Cl. ..... 118/410; 118/211; 118/212; 118/117; 118/118; 118/119; 118/126; 118/259; 118/304

(58) Field of Search ..... 118/211–212, 117–119, 118/126, 259, 304, 410; 427/356

(56) References Cited

U.S. PATENT DOCUMENTS 1,939,012 A 12/1933 Lescallette 4,055,688 A * 10/1977 Caratsch ..... 118/211

FOREIGN PATENT DOCUMENTS

| | | |
|---|---|---|
| DE | 195 08 797 | 8/1996 |
| DE | 195 41 000 | 5/1997 |
| DE | 198 14 212 | 9/1999 |
| GB | 1123128 | 8/1968 |
| JP | 08080467 A | 3/1996 |

OTHER PUBLICATIONS

Kirk Othner, Encyclopedia of Chemical Technology, 3rd Edition, vol. 6, Gravure Coating (pp. 404–406), 1979.*
Der Speedsizer Das Neue Leimpresenkonzept Für Leimen, Wochenblatt Für Papierfabrikation, 1987.

* cited by examiner

*Primary Examiner*—Laura Edwards
(74) *Attorney, Agent, or Firm*—Herbert Dubno

(57) ABSTRACT

An apparatus applies a coating composition consisting of a resin and fine abrasive particles like corundum particles, to a paper web by feeding the composition to the paper web as it loops around a guide roller to a metering roller juxtaposed with the guide roller. The coating composition, which may develop stripes, is then equalized with a structured roller engaging the paper-web pass leaving the guide roller and formed with at least one thread-like structuring element which may be followed by or preceded by a doctor blade arrangement or a smooth-surfaced roller.

10 Claims, 4 Drawing Sheets

APPARATUS FOR APPLYING ABRASIVE SUBSTANCES TO CONTINUOUS PAPER WEBS

FIELD OF THE INVENTION

Our present invention relates to an apparatus for applying a coating composition comprised of a liquid resin and fine-grained abrasive material, especially corundum, to a continuous paper web which can be for the production of wear-resistant laminates.

BACKGROUND OF THE INVENTION

German patent document DE 195 08 797 C1 describes a process for the production of decorative paper which can be used to make wear-resistant laminates. In this system, a viscous mixture of a melamine resin and alpha-cellulose, to which corundum articles are added, is coated as the coating composition onto the visible surfaces of a decorative paper. The alpha-cellulose there serves as a stiffening and suspending agent. The corundum particles have a particle size of 15 to 50 $\mu$m. The coating composition is applied in an amount of 80 to 200 g/m$^2$ so that after the composition has been dried to its final moisture content, a layer thickens to 20 to 65 $\mu$m is obtained. The coating composition os applied by a wire doctor, a reverse coating system or a screen roller.

In German patent document DE 198 14 212 C1, an apparatus has been described which is especially designed for the application of such coating compositions. This apparatus has been successfully in use for some time and can be considered to be a basic coating system over which the present invention is an improvement. With this apparatus, a rerouting or guide roller around which the paper web is looped, is juxtaposed with a metering roller and the metering roller and the guide roller and so synchronized that in the gap between the metering roller and the paper web, there is no relative motion between the web and the coating composition. The peripheral speeds of the rollers and of the paper web, the gap dimension and the directions of movement of the surfaces defining the gap are thus selected to prevent such relative movement in the gap.

In this manner, the wear of the metering roller can be minimized in spite of the fact that the coating composition contains abrasive particles. This system, however, has a problem which may originate in the fact that the two rollers have the same peripheral speed at the gap and that is that, unlike the case where the rollers run in opposite senses, part of the coating composition adheres to the web while another part remains adherent to the metering roller and is drawn away from the web at the downstream side of the gap.

In practice it is found, in such a system, that the layer which adheres to the web is somewhat nonuniform and may have clearly visible longitudinal stripes.

To eliminate this striped pattern, an equalizing system can be provided along the web downstream of the gap. The stripes can be eliminated for example by a doctor blade, e.g. comprised of a substantially rectangular flap of a flexible rubber-like material which is secured on a support bar parallel to the axes of both rollers at a rear edge of the doctor blade and which rests loosely on the coated upper pass of the paper web as it is delivered by the guide or rerouting roller.

Depending upon the consistency of the coating mass which can be a function of the composition selected by the producers of the decorative paper and which may be required for different laminating purposes, such a doctor flap can be more or less effective in removing the undesired strip pattern. In some cases the striped pattern cannot be removed by the use of such a flap or doctor member alone.

U.S. Pat. No. 19 39 012 describes the use of a worm for smoothing the upper surface of moist molded tile blanks. A mold filled with moist clay is passed below the rotating worm which strips off excess clay. The excess clay passes laterally into a shaft where it is collected for reuse.

German patent document DE 195 41 000 describes an apparatus for smoothing continuous plaster fiberboard and comprises substantially of a worm disposed transversely above the conveyor belt for the continuous plaster fiberboards. The rotating worm is formed with a kind of shaver for the surface of the continuously-passing and already set plasterboards. The latter can be either still moist or even dried and the worm removes fine particles which are transported by the worm to the edge of the board and are collected in a container.

OBJECTS OF THE INVENTION

It is, therefore, the principal object of the present invention to provide an apparatus for coating paper webs for the purposes described with an abrasive coating composition and particularly coating compositions containing a resin and corundum particles, whereby the drawbacks of the systems previously described are obviated.

Another object of this invention is to provide an apparatus for coating paper webs in the production of decorative paper with thick coatings containing fine-grain adhesive which ensures uniform coating with coatings which are free from striped patterns characterizing earlier systems and which is not dependent upon the particular coating composition that is the case with some prior coating systems.

SUMMARY OF THE INVENTION

These objects and others which will become apparent hereinafter are attained, in accordance with the present invention, in an apparatus for coating paper webs with a composition as described and which comprises:

- a guide roller around which the web is looped so that the web has a coating-receiving surface extending arcuately around the guide roller;
- a metering roller parallel to the guide roller and having a surface juxtaposed with the surface of the web across a narrow gap;
- a slit nozzle juxtaposed with one of the surfaces for delivering the composition over a width of the web, the composition passing through the gap and forming a coating on the coating-receiving surface of the web; and
- an equalizing device for rendering the coating uniform, the equalizing device including at least one structured roller juxtaposed with the coating-receiving surface downstream of the gap and having a screwthread-like structure.

According to a feature of the invention, the screwthread-like structure can be continuous, i.e. a helical rib extending in one or more turns along the structured roller or discontinuous, i.e. a series of lands or formations arrayed in a helical pattern. The screwthread-like structure can form a single-thread structure or a multiple-thread structure and can be a system of mutually-crossing helical grooves of opposite hand or rotational sense.

According to a feature of the invention, the equalizing device further comprises a doctor blade engaging the coating and located upstream or downstream of the structured roller and in a form of a substantially rectangular flap of a flexible elastomeric material having a rearward edge parallel to the structured roller and fastened to a support and lying slackly upon an upper pass of the web coming off the guide roller.

The equalizing device can further comprise a smooth roller in contact with the coatings and downstream of the structure roller in a direction of travel of the web.

According to another feature of the invention the equalizing device includes at least two parallel structured rollers juxtaposed with the coating-receiving surface downstream of the gap and each having a screwthread-like structure.

It has been found to be advantageous to provide supports for the web close to the equalizing device and upstream and downstream therefrom in a direction of travel of the web. The guide or rerouting roller can form one of these supports while another of these supports is formed by a support roller downstream of the equalization device. The metering roller can be located at least in part above the guide roller at a location in which the web is delivered horizontally from the guide roller and in that case the metering roller can be located vertically above or approximately vertically above the guide roller. With the invention, moreover, a doctor blade can be juxtaposed with the metering roller.

With the system utilizing one or more structured rollers and, if desired, doctor blades or smooth-surfaced rollers downstream thereof in the equalizing device, we are able to ensure stripe-free and uniform coating with practically all compositions containing liquid resins and abrasive particles like corundum on paper web.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
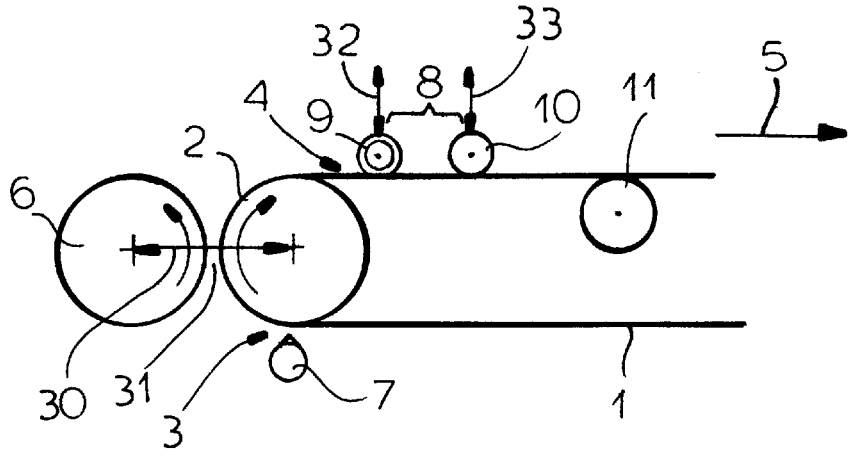
FIGS. 1–3, 3*a* and 4 are diagrammatic side elevational views illustrating various embodiments of the coating systems according to the invention.

In FIG. 1 the paper web is shown to arrive at a rerouting or guide roller 2 at a bottom contact line in a horizontal orientation, to loop around the guide roller 2 through an arc or angular extent of 180° and to leave or be delivered from the guide roller 2 in a horizontal stretch at the top of the roller 2.

The paper web, which has already been preimpregnated with resin can have, in addition, been dried. The loop of the web around the guide roller 2 extends from the 6 o'clock position at which the web meets the roller 2 at the contact line 3 to the 12 o'clock position at which the delivery line 4 is located. From the guide roller 2 the web extends horizontally as represented by the arrow 5 which is intended to indicate the delivery web of the drier not shown.

Close to the guide roller 2 is a smooth-surface metering roller 6 which can have the same diameter as the guide roller 2 in the embodiment illustrated. The axes of the guide or rerouting roller 2 and the metering roller 6 are parallel to one another at the same height and are journaled in a machine frame which has not been illustrated. The journals of the two rollers can be relatively shifted in the horizontal direction as represented by the double-headed arrow 30 which also represents the means for adjusting the width of narrow gap 31 between the web 1 and the metering roller 6 (see also FIG. 2).

The metering roller and the guide roller 2 can be provided with respective drives (see FIG. 8) which can be mechanically or electrically coupled so that the rollers 2 and 6 are synchronously or approximately synchronously driven, i.e. have substantially identical peripheral speeds which can correspond to the speed of advance of the paper web.

Below the guide roller 2 there is a slit nozzle 7 for applying the coating composition to the paper web. The slit nozzle 7 is disposed adjacent the approach line 3.

Figure 8:
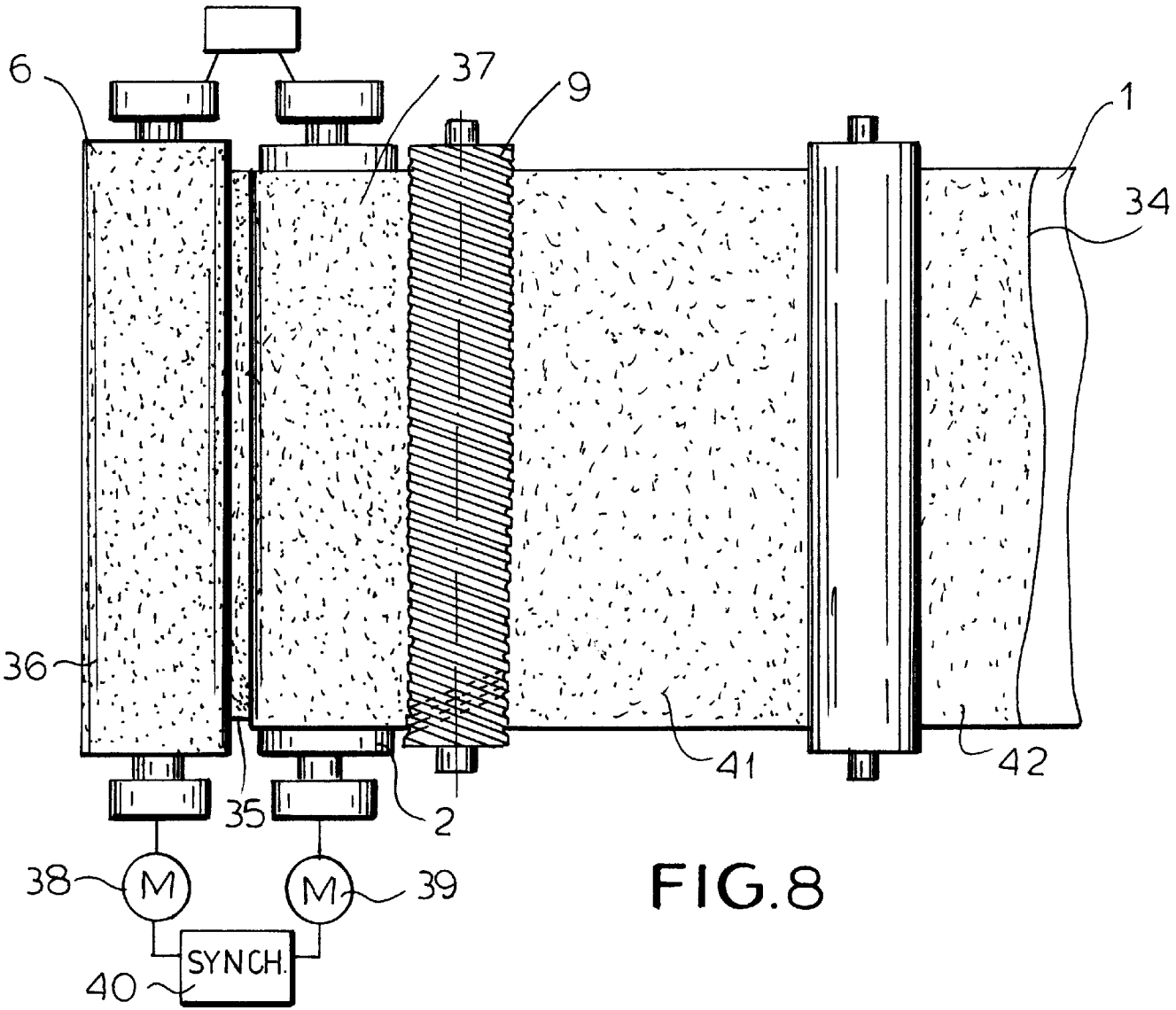
FIG. 8 is a plan view of a coating system in accordance with the invention.

At a short distance from the discharge line 4 and downstream thereof, along the upper pass of the paper web 1, an equalizing device 8 is provided. In the embodiment of FIG. 1 and FIG. 8, it comprises a structured roller 9 and a smooth roller 10 spaced downstream from the structured roller 9 in the direction of advance of the paper web (arrow 5). The structured roller 9 and the smooth roller 10 have height-adjustable bearings and mechanisms represented by the arrows 32 and 33 which effect height adjustment from the rollers 9 and 10 so that distances from the paper web 1 can be varied at a relatively short spacing from the equalizing unit which can correspond approximately to the spacing of roller 10 from the delivery line 4, there is downstream of the equalizing drive and along the underside of the paper web 1 a support roller 11.

Figure 6:
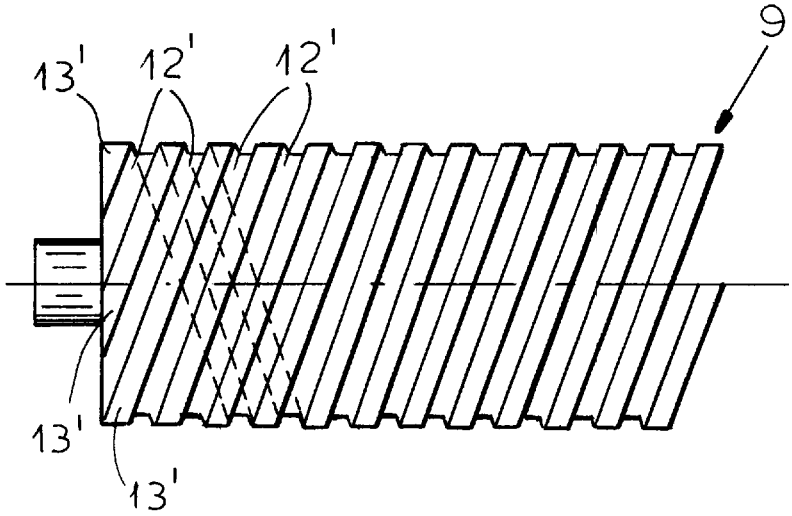

In FIG. 8, a structured roller 9 corresponds to that of FIG. 6 which has been shown to extend all across the width of the paper web 1 and the coating is broken away at 34. The coating is seen at 35 to rise in the gap 31 and to be partly carried at 36 by the metering roller 6 away from the gap while the balance forms the coating 37 on the paper web. The drives for the rollers 2 and 6 are shown as motors 38 and 39 coupled by an electrical synchronizing controller. The coating which has been equalized by the roller 9 is represented at 41 and the final coating 42 preparatory to drying and free from any striped structure is shown at 42 in FIG. 8.

Figure 5:
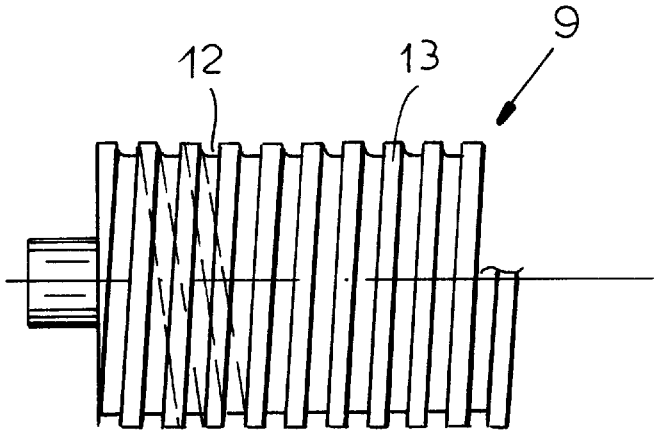
FIGS. 5–7 are fragmentary elevational views showing ends of structured rollers which can be used with the invention.

The structure of the roller 19 can be that of FIGS. 5, 6 or 9. In FIG. 5, for example, it is shown to consist of a single helical groove 13 and a single helical rib 13 of rectangular cross section of the same width as the groove 12. The structure shown in FIG. 1 is that of a single thread and extends over the entire length of the structured roller 9 and the entire width of the web. In FIG. 6, three similar ribs 13', angularly equispaced about a roller 9 form a multiple thread, i.e. a triple thread, the grooves 12' have defined between the ribs. Without altering the cross section of the grooves and ribs, the pitch and pitch angle of the ribs can be increased.

Figure 7:
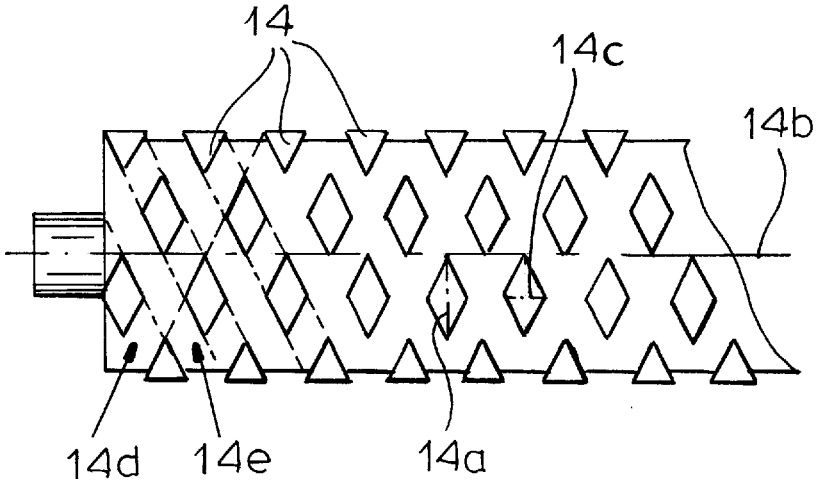

FIG. 7 shows a structured roller which can be used as one of the rollers 9 or 9*a* hereon, in which the helical grooves can be wound in opposite hand and intersect one another, being defined between diamond-shaped lands 14 having one diagonal parallel to the roller axis and another diagonal perpendicular thereto. In the embodiment shown, the lines form 3 right-handed grooves and three left-handed grooves intersecting one another.

In the apparatus of FIGS. 1 and 8, the paper web 1 can travel at a speed between about 10 and 90 m/min, preferably between 20 and 50 m/min. With the slit nozzle 7, the coating composition of a liquid resin and fine corundum particles suspended therein is applied directly to the paper web in excess. The thus-formed layer from the underside of the guide roller 2 is entrained into the gap 31 between the guide roller 2 and the metering roller 6 so that a portion of the coating composition remains adherent to the paper while another part adheres to the metering roller 6. Surplus coating composition is dammed up in the gap 31 and drops off. Since the surface speeds of the rollers 2 and 6 are the same and they travel in the same direction at the gap, there is no noticeable abrasive wear on the metering roller 6.

The layer adherent to the paper web, usually a mean weight per unit area of about 30 to 100 g/m$^2$ is initially nonuniform so that longitudinal strengths are clearly visible therein. The stripes can be eliminated by smoothing the coating via the equalizing device. The stripes tend to arise because of surface tension which draws the coating composition together along a succession of lines so that the strip spacing in width tends to be uniform across the web. The breadth of the stripes is about 5 m/m as a rule, but the spacing between stripes usually. is between 10 and 30 mm. The undesirable stripe pattern varies unpredictably.

The structured roller is so positioned it contacts the paper web. When the structured roller runs fast and has the configuration of FIGS. 5 and 6, the coating mass is briefly engaged by the ribs of the structured roller and is uniformly distributed over the web, thereby eliminating the stripes. In practice it is found that relatively thick stripes are wiped out by this technique. The structured roller does not have any effect on the final coating weight per unit area. In practice it is found that the structured roller, which does not have much area in contact with the coating composition does not wear significantly but it is equally of importance that even significant wear of the structured roller does not have any adverse effect. The smooth roller downstream thereof, also rotated at high speed, effects further smoothing and uniform spreading of the coating composition.

The fact that the support roller 11 is relatively close to the guide roller 2 ensures, for a web maintained under tension, that the sag of the web in the region of the equalizing device is limited to an extent which is not noticeable.

In the embodiment of FIGS. 1 and 8, the structured roller 9 can also be a roller in which the structuring conforms to that shown in FIG. 7. In this Figure, helical grooves of opposite hand, i.e. extending in a left-hand pattern and in a right-hand pattern around the roller, are formed by rhomboidal or diamond-shaped lines or islands 14 whose vertices form acute angles in the direction of rotation of the roller and opposite that direction. As can be seen from FIG. 7, each of the lands 14 may have a long diagonal line 14*a* extending perpendicular to the axis 14*b* of rotation of the roller and a short axis 14*c* extending parallel thereto. The lands 14 can be formed by milling the right-hand grooves 14*d* and the left-hand grooves 14*e* in the surface of the cylindrical roller. The grooves can all be of the same breadth and depth and, where they are also of the same pitch, will be uniformly distributed on the roller.

Figure 2:
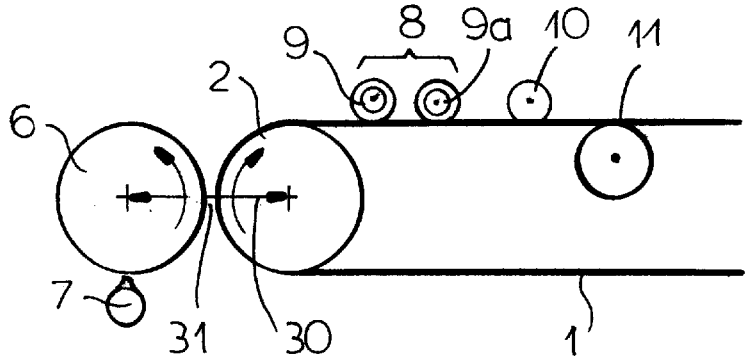

The embodiment of FIG. 2 differs from that of FIG. 1 in that two structured rollers 9 and 9*a* form the equalizing device and are spaced apart in the direction of travel of the web. Either of the rollers may have any of the configurations of the rollers of FIGS. 5–7. The pair of rollers 9 and 9*a* can be followed by a smooth-surfaced roller 10 and the support roller 11 as shown. As also has been illustrated in FIG. 2 and as is applicable to the embodiments of FIGS. 3 and 3*a* as well, the slit nozzle 17 can be provided immediately below the metering roller 6 to deliver the coating composition to the metering roller directly, whence the coating composition is entrained into the gap 31.

Figure 3:
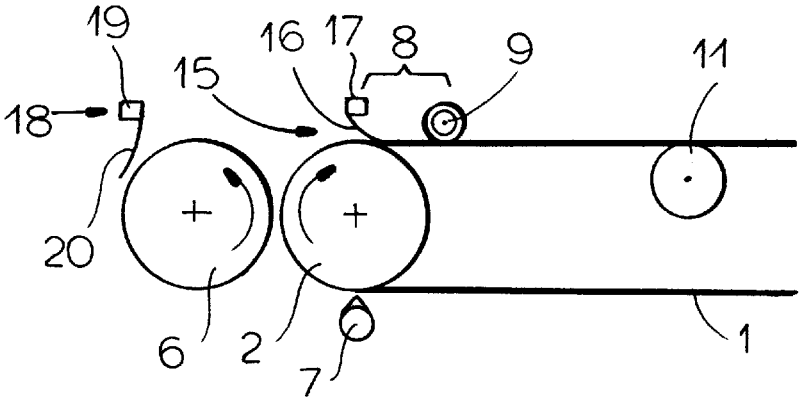
Figure 3A:
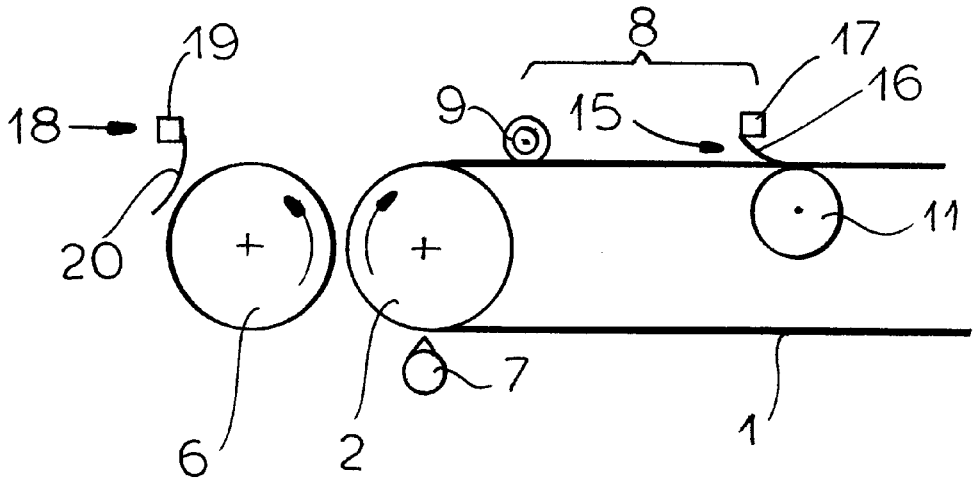

Another embodiment is illustrated in FIG. 3 in which, upstream of the structured roller 9, the equalizing device can comprise a doctor blade 16 in the form of a substantially rectangular flap of flexible elastomeric material whose rear edge is affixed on a support bar 17 extending parallel to the axes of the rollers 2 and 6, above the upper pass of the paper web and such that the free edge of the doctor blade system 15 rests loosely on the paper web. The flap 16 of the doctor blade arrangement 15 provides a presmoothing of the coating, partly eliminating the stripes mentioned previously.

It has been found to be advantageous, as has also been shown in FIG. 3 and as is applicable to the embodiments of FIGS. 1, 2, 3*a* and 4 as well, to provide the metering roller 6 with a similar doctor blade arrangement.

In this case, the support bar 19, which extends parallel to the axes of the rollers 2 and 6, is not located vertically above the metering roller 6 but rather is oriented downstream of the 12 o'clock position, say at an 11 o'clock position, to a side of the metering roller 6 opposite that at which the guide roller 2 is provided. A flexible rectangular synthetic resin flap 20 is suspended at its upper edge from the bar 19 and rests loosely against the metering roller 6. The flap 20 serves to level the coating composition on the metering roller and thus prevents the entrainment via the metering roller of a layer of the coating composition with a nonuniform cross section into the gap.

FIG. 3 a shows an embodiment of the invention which is generally similar to that of FIG. 3 but differs in that the doctor blade arrangement 15 is provided downstream of the structured roller 9 and preferably in the region of the support roller 11. Here the flap 16 serves for smoothing out any remaining stripes in the coating.

Figure 4:
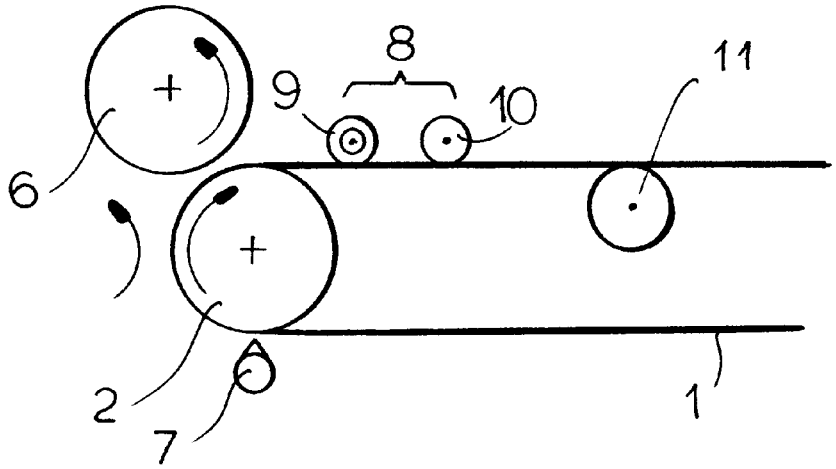

FIG. 4 shows an embodiment of the invention wherein the metering roller 6 is approximately vertically above the guide roller 2, i.e. in an 11 o'clock position with respect to the guide roller 2. Between the metering and the equalization regions of the path of the web, in this embodiment there is only a relatively short stretch and thus a correspondingly short diameter interval which has been found to have an opposite effect on the subsequent equalization or leveling (stripe elimination).

We claim:

1. An apparatus for applying a coating composition containing a liquid resin and fine-grain abrasive material to a continuous paper web, said apparatus comprising:

a guide roller around which said web is looped so that said web has a coating-receiving surface extending arcuately around said guide roller;

a metering roller parallel to said guide roller and having a surface juxtaposed with said surface of said web across a narrow gap;

a slit nozzle juxtaposed with one of said surfaces for delivering said composition over a width of the web, said composition passing through said gap and forming a coating on said coating-receiving surface of said web; and an equalizing device for rendering said coating uniform, said equalizing device including at least one structured roller juxtaposed with said coating-receiving surface downstream of said gap and having a helical rib structure.

2. The apparatus defined in claim 1 wherein said helical rib structure is a multiple screwthread.

3. The apparatus defined in claim 1 wherein said helical rib structure is a system of mutually crossing helical grooves of opposite hand.

4. The apparatus defined in claim 1 wherein said equalizing device further comprises a smooth roller in contact with said coating and downstream of said structured roller in a direction of travel of said web.

5. The apparatus defined in claim 1, further comprising supports for said web close to said device and upstream and downstream therefrom in a direction of travel of the web.

6. The apparatus defined in claim 5 wherein said guide roller forms one of said supports, another of said supports being formed by a support roller downstream of said device.

7. The apparatus defined in claim 1 wherein said metering roller is located at least in part above said guide roller upon delivery of said web horizontally from said guide roller.

8. The apparatus defined in claim 1, further comprising a doctor blade juxtaposed with said metering roller.

9. An apparatus for applying a coating composition containing a liquid resin and fine-grain abrasive material to a continuous paper web, said apparatus comprising:

a guide roller around which said web is looped so that said web has a coating-receiving surface extending arcuately around said guide roller;

a metering roller parallel to said guide roller and having a surface juxtaposed with said surface of said web across a narrow gap;

a slit nozzle juxtaposed with one of said surfaces for delivering said composition over a width of the web, said composition passing through said gap and forming a coating on said coating-receiving surface of said web; and an equalizing device for rendering said coating uniform, said equalizing device including at least one structured roller juxtaposed with said coating-receiving surface downstream of said gap and having a helical rib structure, said equalizing device including at least two parallel structured rollers juxtaposed with said coating-receiving surface downstream of said gap and each having a helical rib structure.

10. An apparatus for applying a coating composition containing a liquid resin and fine-grain abrasive material to a continuous paper web, said apparatus comprising:

a guide roller around which said web is looped so that said web has a coating-receiving surface extending arcuately around said guide roller;

a metering roller parallel to said guide roller and having a surface juxtaposed with said surface of said web across a narrow gap;

a slit nozzle juxtaposed with one of said surfaces for delivering said composition over a width of the web, said composition passing through said gap and forming a coating on said coating-receiving surface of said web; and an equalizing device for rendering said coating uniform, said equalizing device including at least one structured roller juxtaposed with said coating-receiving surface downstream of said gap and having a helical rib structure, said equalizing device further comprising a doctor blade engaging said coating and located upstream or downstream of said structured roller and in a form of a substantially rectangular flap of a flexible elastomeric material having a rearward edge parallel to said structured roller and fastened to a support and lying slackly upon an upper pass of said web coming off said guide roller.

* * * * *